US006116441A

United States Patent [19]

Decelles et al.

[11] Patent Number: 6,116,441

[45] Date of Patent: Sep. 12, 2000

[54] DUAL TAMPER EVIDENT CLOSURE

[75] Inventors: Gilles Decelles; Jo-Philippe K. Laflamme, both of Waterloo, Canada

[73] Assignee: Bouchons Mac Inc., Waterloo, Canada

[21] Appl. No.: 09/333,039

[22] Filed: Jun. 15, 1999

[51] Int. Cl.[7] ..... B65D 47/08

[52] U.S. Cl. ..... 215/237; 215/253; 215/254; 220/259; 220/266; 220/847; 222/153.07; 222/541.5; 222/541.6

[58] Field of Search ..... 215/235, 237, 215/250, 253, 254, 256, 349, 232; 220/265, 266, 259, 847, 833–835; 222/541.1, 541.5, 541.6, 541.9, 153.06, 153.07, 556

[56] References Cited

U.S. PATENT DOCUMENTS

| | | | |
|---|---|---|---|
| 5,201,440 | 4/1993 | Gross | 215/254 X |
| 5,386,918 | 2/1995 | Neveras et al. | 220/266 X |
| 5,392,938 | 2/1995 | Dubach | 220/266 X |
| 5,497,906 | 3/1996 | Dubach | 220/266 X |
| 5,662,245 | 9/1997 | Grant | 222/153.07 |
| 5,685,444 | 11/1997 | Valley | 215/237 X |
| 5,799,840 | 9/1998 | Mogard | 220/259 X |
| 5,875,907 | 3/1999 | Lay | 220/259 X |
| 5,996,849 | 12/1999 | Bansal | 215/253 X |

*Primary Examiner*—Nathan J. Newhouse
*Attorney, Agent, or Firm*—Robic

[57] ABSTRACT

A dual tamper evident closure for sealing the neck portion of a container. The closure which is preferably made of one single piece of plastic material, has a body with a skirt sized and shaped to fit onto and be screwed or otherwise detachably fixed to the neck portion. The body also has a top surface with an opening in registry with the outlet of the neck portion. The closure also has a cap that is connected to the closure body by a hinge and is sized and shaped to cover the opening of the body and thus to close the outlet of the neck portion when folded down in a closed position. A tamper evident band in the form of a ring is connected by frangible bridges to the lower edge of the skirt of the body. This band is provided with hooks designed to cooperate with an annular bead projecting from the neck portion in order to rigidly retain the body onto the neck portion. A tear tab integrally projects from the peripheral edge of the closure cap in a position that is opposite to the hinge. This tear tab has an upper end that is connected by a frangible bridge to the peripheral edge of the closure cap, and a lower end that is rigidly connected to the tamper evident band. In use, the tear tab as long as it remains connected to the closure cap, warrants that the closure cap has not been lifted up and thus the container has not been opened.

8 Claims, 4 Drawing Sheets

DUAL TAMPER EVIDENT CLOSURE

BACKGROUND OF THE INVENTION a) Field of the Invention

The present invention relates to a tamper evident closure for use on a container, bottle or any similar article (hereinafter called "container" only) provided with a neck portion that defines an outlet.

More specifically, the invention relates to a dual tamper evident closure which, thanks to its improved structure, warrants the consumer that the container has never been opened at all by either removal of the whole closure or opening of the cap of the closure.

b) Brief Description of the Prior Art

Tamper evident closure for containers of the type comprising a tamper evident band in the form of a ring connected by means of frangible bridges to the lower edge of the skirt of the body of the closure, are well known and commonly used in the trade. In this connection, reference can be made, by way of nonrestrictive examples, to U.S. Pat. Nos. 4,658,976 (POHLENZ) and 4,915,244 (CELASCHI).

Tamper evident closures comprising a foldable cap which is connected to the closure body by means of a security band or a frangible bridge that must be torn out before the cap is opened for the first time, are also known. Examples of such closures are disclosed in U.S. Pat. Nos. 4,487,324 (OSTROWSKY); 5,147,054 (PEHR) and 5,392,938 (DUBACH).

SUMMARY OF THE INVENTION

The object of the invention is to provide a dual tamper evident closure which, in addition to comprising a tamper evident band of conventional structure, also comprises an "integral" tear tab that warrants the consumer who buys the container that the cap of the closure has never been opened.

More particularly, the invention provides a dual tamper evident closure for sealing a container comprising a neck portion that defines an outlet and has an external surface provided with upper and lower connection means.

This closure comprises:

a closure body comprising

- a skirt sized and shaped to fit onto the neck portion, the skirt having a lower edge and comprising an internal surface provided with skirt connection means designed and positioned to cooperate with the upper connection means of the neck portion in order to detachably connect the closure body to the neck portion; and
- a top surface comprising an opening that is in registry with the outlet of the neck portion when the closure body is connected to the neck portion, The closure also comprises a top wall and a peripheral edge. The closure cap is connected to the closure body by means of a hinge and is sized and shaped to cover the opening of the closure body and thus to close the outlet of the neck portion when folded down in a closed position.

The closure further comprises a tamper-evident band comprising a ring connected by means of frangible bridges to the lower edge of the skirt of the closure body. The band is provided with hooking means designed to cooperate with the lower connection means of the neck portion in order to rigidly retain the closure body onto this neck portion.

In accordance with a very important aspect of the invention, the closure comprises also a tear tab integrally projecting from the peripheral edge of the closure cap in a position that is opposite to the hinge. This tear tab has an upper end that is connected by a frangible bridge to the peripheral edge of the closure cap and a lower end that is rigidly connected to the tamper-evident band.

In use, the tear tab, as long as it remains connected to the closure cap, warrants that the closure cap has not been lifted up and thus that the container has not been opened.

Preferably, the closure is made of one single piece of plastic material, preferably polypropylene.

Preferably also, the lower end of the tear tab is connected to the tamper evident band by ultrasonic welding.

In practice, after molding of the closure, the cap is folded down onto the body to close the opening in the top surface of the same. The tear tab that is integral to the cap, is then rigidly connected preferably by ultrasonic welding to the tamper evident band which thus assumes two separate functions:

- it warrants, as long as it remains attached to the lower edge of the body skirt, that the closure has not been removed from the neck portion; and
- it warrants, as long as the tear tab remains attached to the cap and to it, that the cap has not been opened.

In order to open the container, one has to break the tear tab first, and then to tear out the tamper evident band to which the tear tab is welded. Thereafter, the closure can be removed from the neck portion of the container to give access to the same and to allow removal of a liner that is usually applied on top of the outlet of the container.

BRIEF DESCRIPTION OF THE DRAWINGS

The invention and its advantages will be better understood upon reading the following non-restrictive description of a preferred embodiment thereof made with reference to the accompanying drawings wherein.

DESCRIPTION OF A PREFERRED EMBODIMENT OF THE INVENTION

Figure 1:
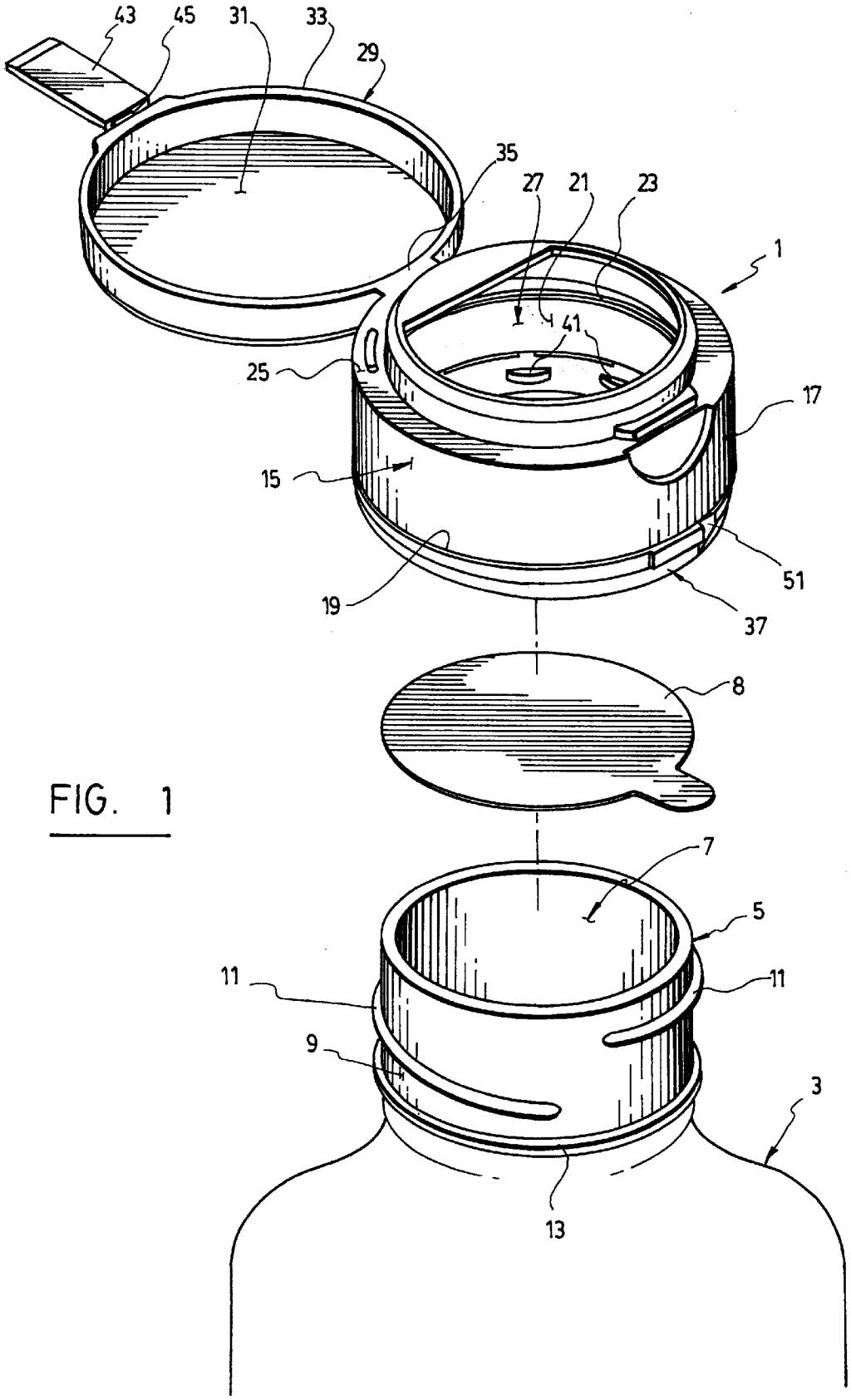
FIG. 1 is an exploded perspective view of the neck portion of a container and of a dual tamper evident closure according to the invention for use with this container.

The dual tamper evident closure 1 according to the preferred embodiment of the invention as shown in the accompanying drawings, is intended to be used for sealing a container 3 comprising a neck portion 5 that defines an outlet 7. The neck portion 5 has an external surface 9 provided with upper and lower connection means 11, 13. In the preferred embodiment that is illustrated, the upper connection means 11 consists of one or more threads made on the external surface 9 of the neck portion 5. However, any other connection means commonly used in the trade for detachably connecting a closure to the neck of a container could alternatively be used. Similarly, in the illustrated embodiment, the lower connection means 13 of the neck portion 5 consists of an annular bead projecting out from the external surface of the neck portion. However, other connection means used in the trade for the same purpose could alternatively be used.

Preferably, as shown in FIG. 1, the outlet 7 of the neck portion 5 of the container is closed by a liner 8 that can be glued or welded to the upper edge of the neck portion, and must be pulled out to give access to the container. The use of such a liner 8 is rather conventional, especially for containers in medical field, and needs not be further discussed.

Like all existing closures, the closure 1 comprises a closure body 15 which comprises a skirt 17 sized and shaped to fit onto the neck portion 5. The skirt has a lower edge 19 and comprises an internal surface 21 provided with skirt connection means 23 designed and positioned to cooperate with the upper connection means 11 of the neck portion 5 in order to detachably connect the closure body 15 to the neck portion. In the illustrated embodiment, the skirt connection means 23 consists of one or more threads that are opposite to and cooperatively mounted relative to the thread(s) 11 to allow the closure body to be screwed onto the neck. The closure body 15 also comprises a top surface 25 comprising an opening 27 that is in registry with the outlet 7 of the neck portion 5 when the closure body is connected to this neck portion. The shape and configuration of the top surface 25 and the size of the opening 27 may of course vary depending on the kind of product stored in the container 3.

The closure 1 also comprises a closure cap 29 which comprises a top wall 31 and a peripheral edge 33. The closure cap 29 is connected to the closure body 15 by means of a hinge 35 and is sized and shaped to cover the opening 27 of the closure body and thus to close the outlet 7 of the neck portion 5 when folded down in a closed position.

The closure 1 further comprises a tamper evident band 37 consisting of a ring connected by means of frangible bridges 39 to the lower edge 19 of the skirt 17 of the closure body 15. As better shown in FIGS. 5 and 6, the band 37 is provided with hooking means 41 designed to cooperate with the lower connection means 13 of the neck portion 5 in order to rigidly retain the closure body 15 onto the neck portion. This basic structure and the advantage of using such a tamper evident band 37 are well known (see the "Brief description of the prior art" hereinabove) and need not be further discussed.

In accordance with the invention, the closure 1, the structure of which has just been disclosed, is characterized in that it further comprises a tear tab 43 integrally projecting from the peripheral edge of the closure cap in a position that is opposite to the hinge 35. As is shown, the tab 43 has an upper end that is connected by a frangible bridge 45 to the peripheral edge 33 of the closure cap 29. It also has a lower end 47 that is devised to be rigidly connected to the tamper evident band 37. As is also shown, the tab 43 is sized so that its lower end 49 be connectable to the external surface of the tamper evident band 37.

Figure 2:
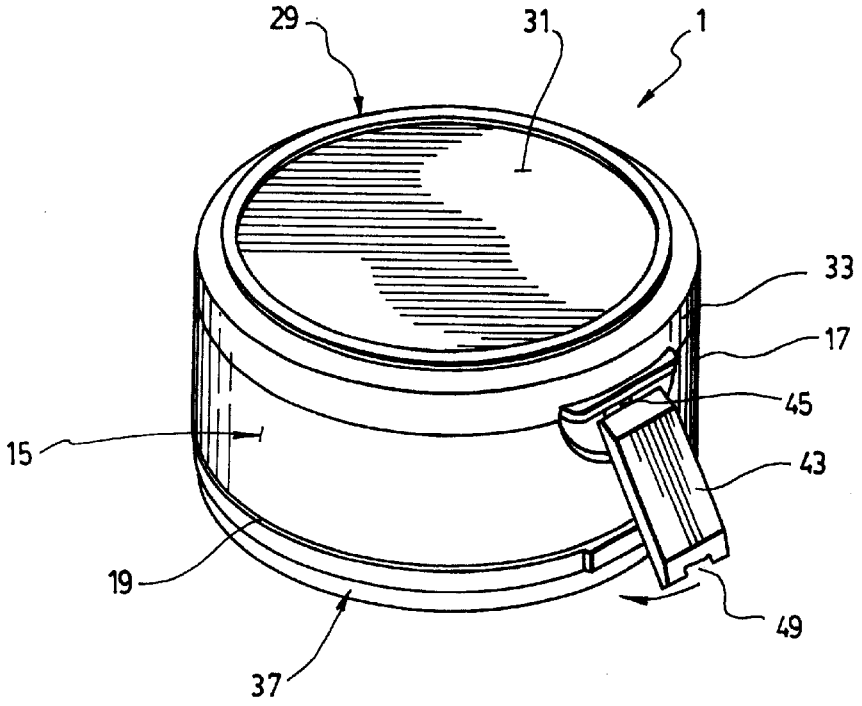
FIG. 2 is a perspective view of the closure shown in FIG. 1, during its assembly.
Figure 3:
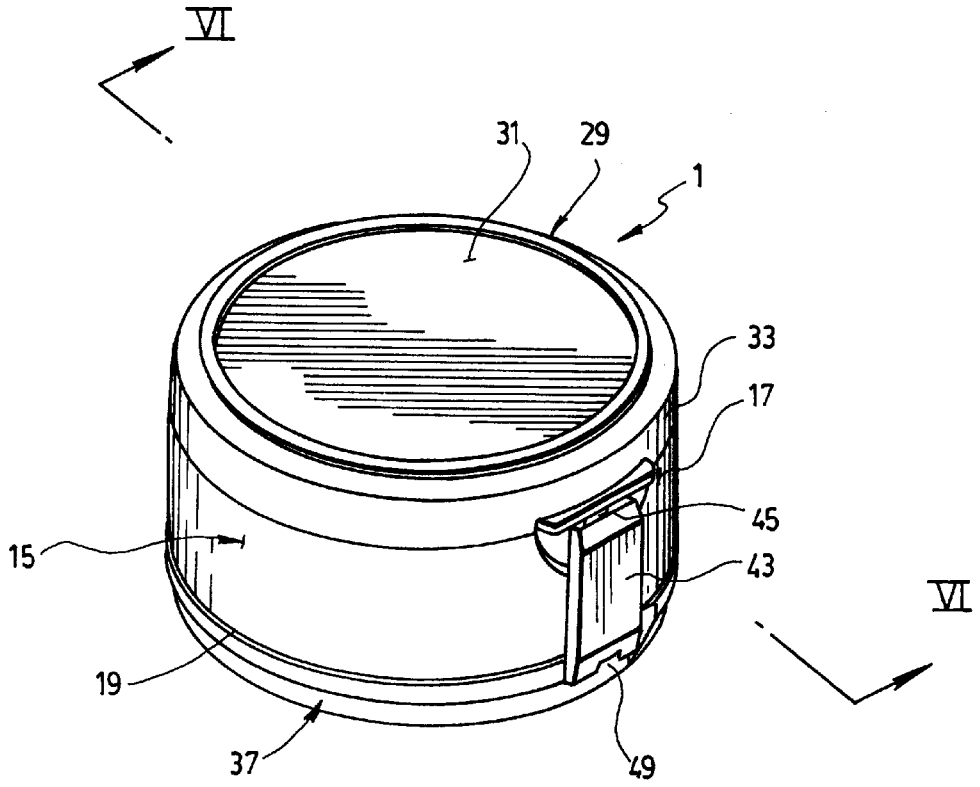
FIG. 3 is a perspective view of the closure shown in FIGS. 1 and 2, once assembled.

In use, after the cap 29 has been closed onto the body 15 of the closure 1, the tear tab can be folded down as shown in FIG. 2 and then attached to the tamper-evident band 37 as shown in FIG. 3. With the tear tab in such an attached position, the tamper evident band 37 assumes two separate functions:

it warrants, as long as it remains attached to the lower edge 19 of the skirt 17, that the closure 1 has not been removed from the neck portion 5; and it warrants, as long as the tear tab 43 remains attached to it, that the cap has not been opened.

In order to open the container, one has first to break the tear tab 43. Such can be done thanks to the frangible bridge 45. Secondly, one has to break the tamper evident band 37. Then, the closure 1 may be removed from the container 3 in order to facilitate removal of the liner 8 closing the outlet of the same. In other words, the liner 8 may be fully is removed only after the tear tab 43 and the tamper evident band 37 have been pulled out and the closure body 15 and the closure cap 29 have been unscrewed from the neck portion 5.

Figure 4:
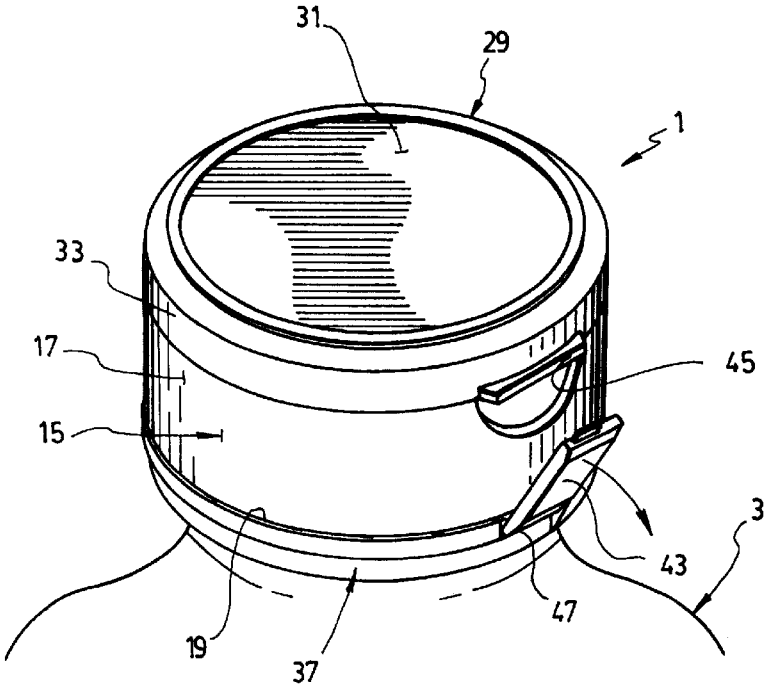
FIG. 4 is a perspective view of the closure shown in the preceding Figures during its opening on top of the container.
Figure 5:
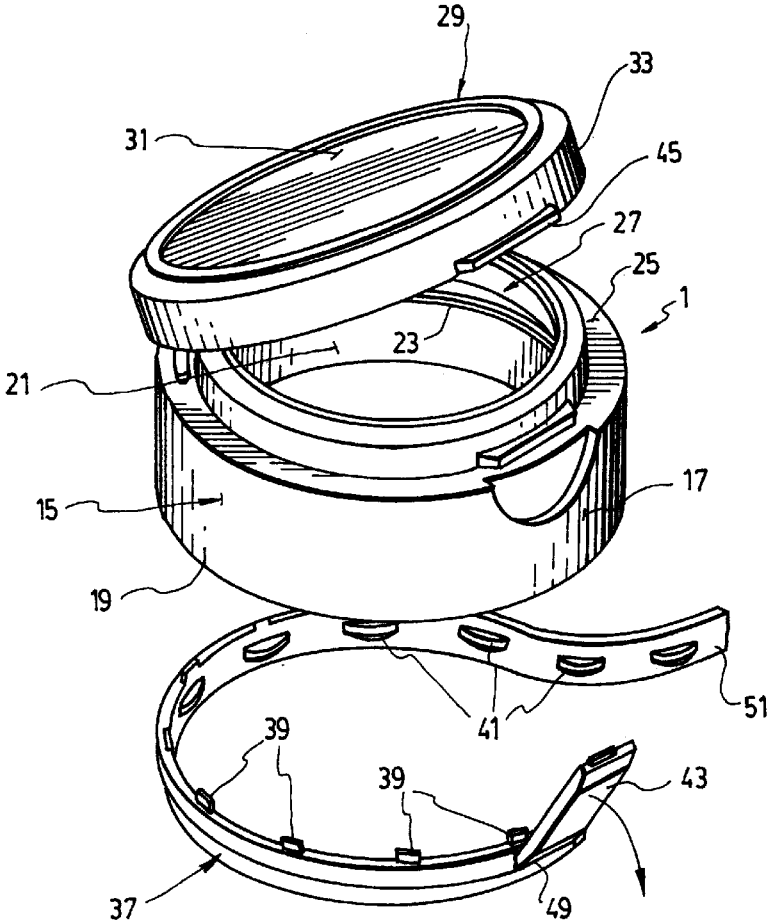
FIG. 5 is an exploded perspective view of the closure shown in the preceding Figures, after the tamper evident band has been torn away and the closure cap has been lifted up.
Figure 6:
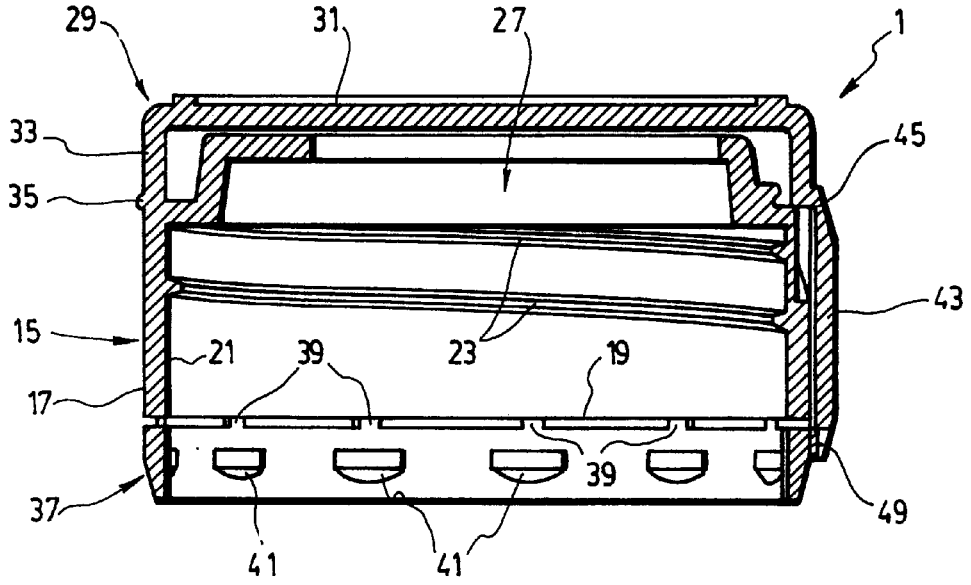
FIG. 6 is a cross-sectional view taken along line VI—VI of FIG. 3.
Figure 7:
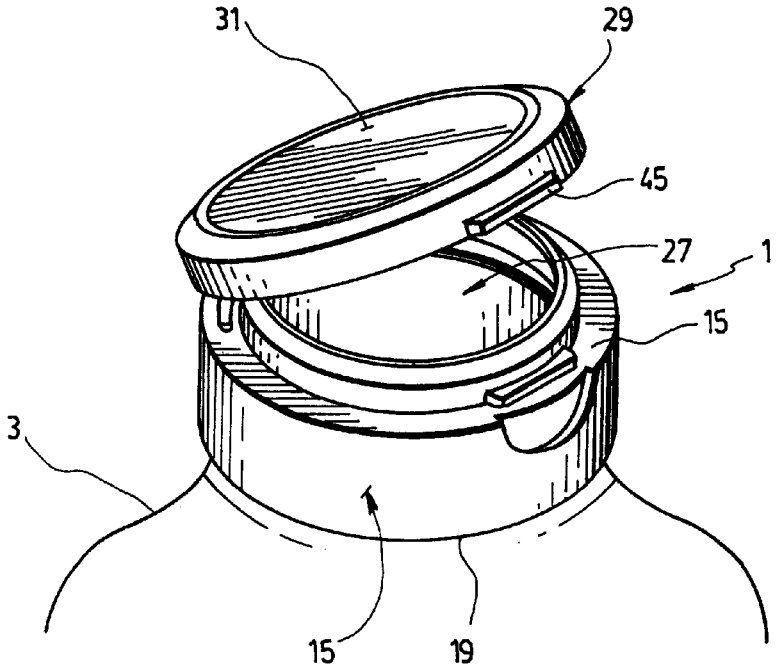
FIG. 7 is a perspective view of the neck portion of the container and the closure shown in FIG. 1, after opening of the closure and reinstallation of it on the container.

To facilitate breaking of the tamper evident band 37, the ring forming said band 37 is preferably provided with a frangible portion 51 (see FIGS. 1 and 5) that allows the ring 37 to be easily cut and then torn away for the skirt 17 when one pulls on the tear tab 49 after the upper end of the tear tab has been torn away from the closure cap 29 (see the arrow in FIGS. 4 and 5).

Thus, in use, the tear tab 43, as long as it remains connected to the closure cap 29, warrants that the closure cap 29 has not been lifted up and thus the container 3 has not been opened.

Preferably, the closure 1 is made of one single piece of plastic material by molding. The plastic material is preferably polypropylene or other suitable material. In such a case, the lower end 49 of the tear tab 43 is connected to the tamper evident band 39 by ultrasonic welding. However, it should be understood that other means for connecting the lower end 49 of the tear tab 43 to the tamper evident band 39 could be used.

Of course, numerous modifications could be made to the above-described embodiment without departing from the scope of the present invention. By way of example, instead of being integral to the cap, the tear tab 43 could be integral to the tamper evident band 37 and welded to the cap 29. This would probably be less efficient than the preferred embodiment illustrated in the drawings since additional frangible lines or bridges would be required, but such would work in the same way. Similarly, the basic structure of the skirt and cap could be modified depending on the kind of container the closure would fit, and the kind of product contained in the container.

What is claimed is:

1. A dual tamper evident closure for sealing a container comprising a neck portion that defines an outlet and has an external surface provided with upper and lower connection means, said closure comprising:

a) a closure body comprising:

a skirt sized and shaped to fit onto the neck portion, said skirt having a lower edge and comprising an internal surface provided with skirt connection means designed and positioned to cooperate with the upper connection means of the neck portion in order to detachably connect the closure body to the neck portion; and a top surface comprising an opening that is in registry with the outlet of the neck portion when the closure body is connected to said neck portion, b) a closure cap comprising a top wall and a peripheral edge, said closure cap being connected to the closure body by means of a hinge and being sized and shaped to cover the opening of said closure body and thus to close the outlet of the neck portion when folded down in a closed position;

c) a tamper-evident band comprising a ring connected by means of frangible bridges to the lower edge of the skirt of the closure body, said band being provided with hooking means designed to cooperate with the lower connection means of the neck portion in order to rigidly retain the closure body onto said neck portion; and d) a tear tab integrally projecting from the peripheral edge of the closure cap in a position that is opposite to the hinge, said tear tab having an upper end that is connected by a frangible bridge to the peripheral edge of the closure cap and a lower end that is rigidly connected to the tamper-evident band, whereby, in use, the tear tab, as long as it remains connected to the closure cap, warrants that the closure cap has not been lifted up and thus the container has not been opened.

2. A dual tamper evident closure as claimed in claim 1, wherein said closure is made of one single piece of plastic material.

3. A dual tamper evident closure as claimed in claim 2, wherein the lower end of the tear tab is connected to the tamper evident band by ultrasonic welding.

4. A dual tamper evident closure as claimed in claim 3, wherein:

the lower connection means of the neck portion consists of an annular bead projecting out from the external surface of the neck portion; and the ring of the tamper evident band comprises a frangible portion that allows the ring to be easily cut and then to be torn away from the skirt when one pulls on the tear tab after the upper end of said tear tab has been torn away from the closure cap.

5. A dual tamper evident closure as claimed in claim 4, wherein the upper connection means of the neck portion and the skirt connection means of the closure body consist of opposite threads made in the external surface of the neck portion and in the internal surface of the skirt, respectively.

6. A dual tamper evident closure as claimed in claim 5, wherein the outlet of the neck portion of the container is closed by a liner that is pulled out to give access to the container after the tear tab and the tamper evident band have been pulled out and the closure body and the closure cap have been unscrewed from the neck portion.

7. A dual tamper evident closure as claimed in claim 6 , wherein said plastic material is polypropylene.

8. A dual tamper evident closure as claimed in claim 2, wherein:

said plastic material is polypropylene; and the lower end of the tear tab is connected to the tamper evident band by ultrasonic welding.

* * * * *